United States Patent [19]

Kashio

[11] 4,165,605

[45] Aug. 28, 1979

[54] ELECTRONIC TIMEPIECE

[75] Inventor: Toshio Kashio, Tokyo, Japan

[73] Assignee: Casio Computer Co. Ltd., Tokyo, Japan

[21] Appl. No.: 801,376

[22] Filed: May 27, 1977

[30] Foreign Application Priority Data

May 29, 1976 [JP] Japan ..... 51-62751

[51] Int. Cl.[2] ..... G04C 13/02

[52] U.S. Cl. ..... 58/24 R; 58/50 R; 58/85.5; 58/26 R; 58/35 R

[58] Field of Search ..... 58/23 R, 50 R, 85.5, 58/24 R, 26 R, 35 R; 73/6

[56] References Cited

U.S. PATENT DOCUMENTS

| | | | |
|---|---|---|---|
| 3,681,914 | 8/1972 | Loewengart | 58/24 R |
| 3,777,471 | 12/1973 | Koehler et al. | 58/85.5 X |
| 3,852,953 | 12/1974 | Mischiatti | 58/24 R |
| 3,895,486 | 7/1975 | Hammer et al. | 58/23 R |
| 3,922,844 | 12/1975 | Sakamoto | 58/85.5 X |
| 4,023,344 | 5/1977 | Mukaiyama | 58/24 R |

*Primary Examiner*—Ulysses Weldon

*Attorney, Agent, or Firm*—Frishauf, Holtz, Goodman and Woodward

[57] ABSTRACT

An electronic timepiece comprises a reference oscillator, a counter for counting reference clock signals from the reference oscillator to obtain a time count signal, and a display device for displaying a time count value of the counter, in which there is provided an input terminal detachably connected to an external data supply device to permit a preset initial count value data to be inputted from the outside. A master device for the timepiece includes an output terminal detachably connected to the input terminal of the timepiece. The preset initial count value data is supplied to the counter of the timepiece through the output terminal which is detachably connected to the input terminal of the timepiece.

16 Claims, 7 Drawing Figures

ELECTRONIC TIMEPIECE

BACKGROUND OF THE INVENTION

This invention relates to an electronic timepiece, such as a wristwatch, which is capable of effecting an easy, efficient initial time setting.

An electronic timepiece is already known in which a time count value is displayed by digitally counting oscillation clock signals from a reference oscillator, such as a crystal oscillator, which provides an accurate, stable oscillation. The electronic timepiece of this type includes time count circuits corresponding to time units such as a second, a minute, an hour, a day-of-week, a date-of-month, a month data. The time count circuits are driven by reference clock signals from the reference oscillator and time count data corresponding to the respective time count units are displayed on a display device. Such an electronic timepiece assures a very accurate time counting operation which is associated with the oscillation frequency accuracy of the reference oscillator. Therefore, a time counting error is very small, for example, on the order of about 10 seconds and a time count error exceeding a minute will not occur. For this reason, a crystal oscillator type electronic timepiece is rated high as a time count device. However, it is required that the electronic timepiece be set to a correct time at such a time as when it is subjected to a final check for shipment as merchandise or when a new battery is incorporated into the timepiece. That is, a correct time is preset in a time count circuit of the electronic timepiece. A switch for arbitrarily selecting each time count unit is provided, separately from a switch for controlling a normal time count operation, so as to permit a preset value to be inputted into the timepiece. The provision of such a switch requires much time and labor from the standpoint of manufacture, preventing an enhancement of productivity such as an enhancement of a check efficiency in particular. In a compact timepiece such as a wristwatch it is necessary to provide such a switch which is used only when a final check is made for shipment or only when a new battery is put into the timepiece. Furthermore, a cumbersome operation is involved due to the presence of such a switch.

It is accordingly the object of this invention to provide an improved electronic timepiece which is free from the above-mentioned drawbacks and capable of readily effecting a time correction operation.

SUMMARY OF THE INVENTION

According to this invention there is provided an electronic timepiece comprising a reference oscillator, count means for counting reference clock signals from the reference oscillator to obtain a time count signal, a display means for displaying a time count value of the count means, and an input terminal adapted to be detachably connected to an external data supply device to permit a preset initial time count data to be inputted from the outside to the count means at a time setting time.

According to this invention a correct time data can be readily inputted in a timepiece at a final manufacturing step or at a battery replacement time or when a time setting is made, for example, in a jewelry shop.

BRIEF DESCRIPTION OF THE DRAWINGS

This invention will be further described by way of example by referring to the accompanying drawings in which.

DETAILED DESCRIPTION

One embodiment of this invention will now be explained by referring to the accompanying drawings.

Figure 1:
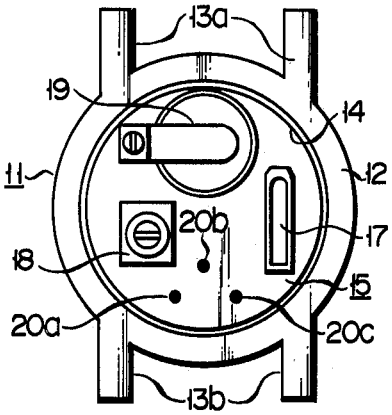
FIG. 1 is a rear view showing an electronic timepiece according to this invention with its rear cover removed.
Figure 2:
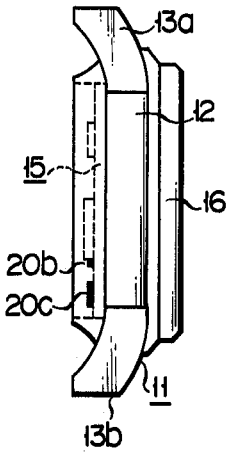
FIG. 2 is a side view showing the electronic timepiece in FIG. 1.

In FIGS. 1 and 2 a reference numeral 11 shows a wristwatch having a case 12. The case 12 is shown with a back cover in the open state and has wristwatch band connectors 13*a* and 13*b* which are formed integral therewith and extending in a direction of the diameter of the case 12. A wristwatch body 15 is received, for example, in the circular recess 14. A digital type time display device (not shown) made of, for example, a liquid crystal is provided at the surface side of the wristwatch body and a glass 16 is sealed on that surface side of the case 12 which the time display device confronts.

The wristwatch body 15 includes a crystal oscillator 17, a trimmer capacitor 18 for effecting a fine adjustment of oscillation clock signals from the oscillator 17, a solid state circuit (not shown) adapted to effecting a time counting of the oscillation clock signals and supply a time display signal to the time display device and a battery 19 acting as a power source for the oscillator 17 and solid state circuit. Three contact terminals 20*a*, 20*b* and 20*c* are properly exposed on the side of the back cover and they are used in inputting preset data at the time setting time as will be set out below.

Figure 3:
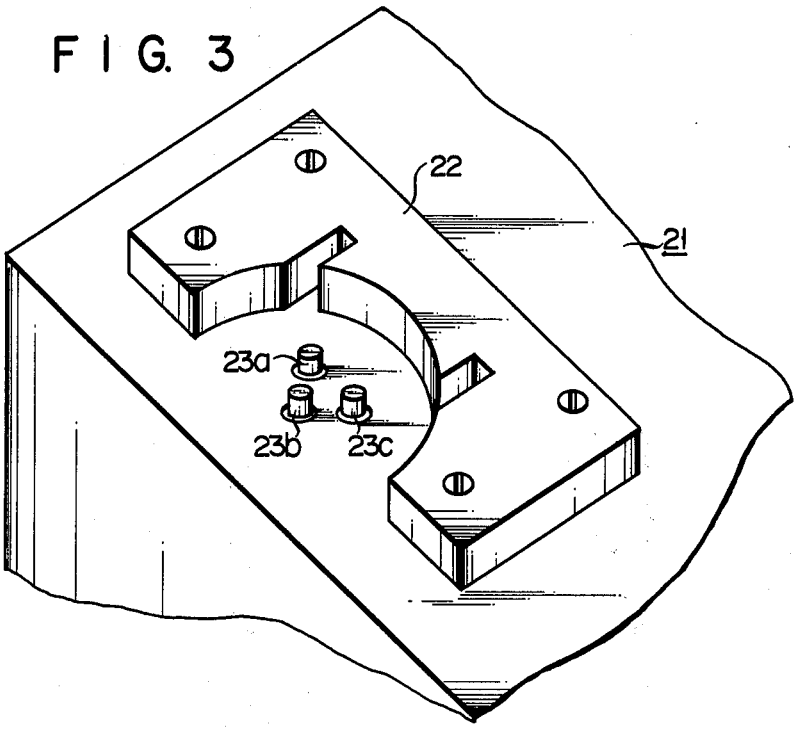
FIG. 3 is a view showing a major part of a master device for supplying a correct time to the timepiece.

At the time setting time the preset data is inputted from a master device 21 shown in FIG. 3. A position setting mechanism 22 is mounted on the master device 21 and corresponds in shape to the outer configuration of the case 12 of the wristwatch 11. Projecting terminals 23*a*, 23*b* and 23*c* are so disposed that when the wristwatch 11 is positioned in the position setting mechanism 22 of the master device 12 they face the corresponding contact terminals 23*a*, 23*b* and 23*c*.

Figure 4:
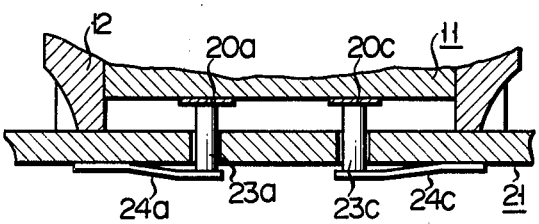
FIG. 4 is a cross-sectional view showing the state in which the electronic timepiece and master device are connected.

As shown for example in FIG. 4 the projecting terminals 23*a* to 23*c* are supported and urged by springs 24*a* to 24*c* in the outer direction and, when the wristwatch 11 is positioned in the master device 21, they are brought into an elastic, positive engagement with the corresponding contact terminals 20*a* to 20*c*, permitting a positive transmission of electrical signals.

Figure 5:
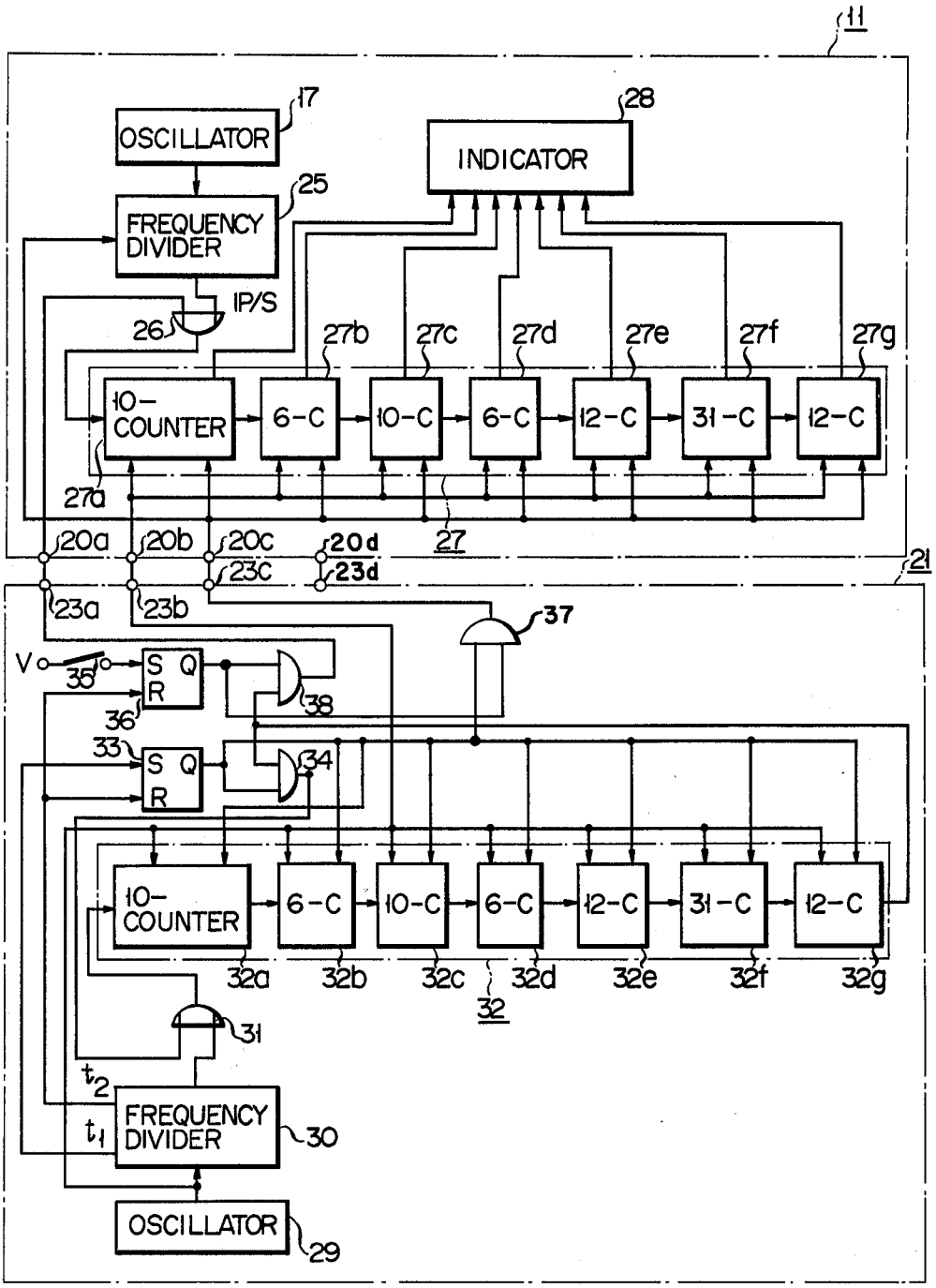
FIG. 5 is a block diagram showing a master device and an electronic timepiece according to one embodiment.

FIG. 5 is a circuit diagram showing a relation of the wristwatch 11 to the master device 21 on which it was positioned. In the wristwatch 11 the oscillator 17 is adapted to generate reference clock signals. The clock signals of the oscillator 17 are properly frequency divided at a frequency divider 25 into, for example, 1 second/1 pulse (1 P/S) clock signals. The 1 P/S clock signal of the frequency divider 25 is supplied as a count step signal to a decimal "second" counter 27*a* through an OR circuit 26. The "second" counter 27*a* is adapted to count time data in units of 1 second and generate a carry signal for every 10 seconds. The carry signals are fed to a scale-of-6 "10-second" counter 27*b* adapted to count time data in 10-second units and generate a carry signal for each 60 seconds. The carry signal of the "10-second" counter is coupled to a "minute" counter 27*a*. That is, a time counting circuit 27 comprises the time counters 27*a*, 27*b*, 27*c*, 27*d*, 27*e*, 27*f*, 27*g*, which are adapted to digitally count clock pulses for the respective time count units. The time count signals of the time count circuit 27 is supplied to the display device 28 for digital time display.

A signal from the contact terminal 20*a* is delivered to the OR circuit 26 and a time count data signal is supplied from the master device 21 to the terminal 20*a*. A drive clock signal is supplied from the master device 21 to the contact terminal 20*b* and a time setting control signal is supplied to the contact terminal 20*c*. The control signal supplies a preset instruction to the frequency dividers 25 of the wristwatch 11. At the time counting time the time counts 27*a*, 27*b*, 27*c*, 27*d*, 27*e*, 27*f*, 27*g* of the time count circuit act as a shift register which permits a serial data shift upon receipt of clock pulse signals from the contact terminal 20*b*.

The master device 21, on the other hand, includes an oscillator 29 and frequency divider 30. The 1 P/S clock signal of the frequency divider 30 is supplied through an OR circuit to a time count circuit 32 which, like the time count circuit 27 of the wristwatch 11, comprises time counters 32*a*, 32*b*, 32*c*, 32*d*, 32*e*, 32*f*, 32*g*. The time counters 32*a*, 32*b*, 32*c* . . . 32*g* of the time count circuit 32 act as a shift register and permit a serial data shift upon receipt of clock signals which are generated from the oscillator 29 when a flip-flop circuit 33 is set. The output of the time count circuit 32 is delivered to an AND circuit 38 and an AND circuit 34 whose gate is opened when the flip-flop circuit 33 is set. The AND circuit 38 is coupled to the projecting terminal 23*a* and the time count data signal of the AND circuit 34 is fed back to the time count circuit 32 through the OR circuit 31 so that it is held. The flip-flop circuit 33 is set by a signal $t_1$, different in phase from the 1 P/S signal, from the frequency divider 30 and reset by a signal $t_2$ which is generated from the frequency divider after a time corresponding to one shift cycle of the time count circuit 32.

The master device 21 has an instruction switch 35 for time setting. The instruction switch 32 is closed when a time setting is made. Upon closure of the instruction switch 35 the flip-flop circuit 36 is set. The set output signal of the flip-flop circuit 36 is coupled to the AND circuit 38 and, together with the set output signal of the flip-flop circuit 33, to the AND circuit 37. The output signal of the AND circuit 37 is supplied as a control signal to the projecting terminal 23*c*. A clock signal the same as the clock signal for shift to the time count circuit 32 is coupled to the projecting terminal 23*b*.

That is, the wristwatch 11 is so set on the master device 21 that the contact terminals 20*a* to 20*c* are brought into contact with the projecting terminals 23*a* to 23*c*. At this time the time count circuit 27 of the wristwatch 11 effects a time counting operation by oscillation signals from the oscillator 17, but it is required that a correct time be set in the wristwatch. In contrast, the time count circuit 32 of the master device 21 effects a correct time counting operation by the oscillation signals of the oscillator 29 and a correct time is set on the master device 21. The time count data signal is being supplied to the AND circuit 38 during the time $t_1$ to $t_2$ (corresponding to one shift cycle time of the time count circuit 32) in which the flip-flop circuit 33 is set. When in this state the instruction switch 35 is closed, the flip-flop circuit 36 is set. The time count data signal is shifted through the time count circuit 32 during the set time of the flip-flop circuit 33 and a control signal is generated through the AND circuit 37. The control signal of the AND circuit 37 is coupled through terminals 23*c* and 20*c* to the time count circuit 27 to permit a serial data shift to be effected at the time count circuit 27. That is, the time count circuit 27 have its contents shifted by clock signals from the contact terminal 20*b*. In synchronism with the clock signals the time count data from the master device 21 is coupled through the AND circuit 38 and OR circuit 26 to the time count circuit 27. In this way, a correct time count data of the master device 21 is written in the time count circuit 27 of the wristwatch 11. When the time counts data of the time count circuit 32 in the master device 21 is written in the time count circuit 27 in the wristwatch 11 the flip-flop circuits 33 and 36 are reset and a correct time is set in the wristwatch.

It should be noted that the frequency divider 25 of the wristwatch 11 is preset by a control input from the AND circuit 37 of the master device 21 to the same state as that of the frequency divider 30 of the master device 21. Thus, the time count state of the wristwatch 11 is made coincident with that of the master device 21 and a correct time is inputted in the wristwatch 11. In FIG. 5, the wristwatch 11 and master device 21 are set to the same ground level through those grounded parts 20*d* and 23*d* of the case.

Figure 6:
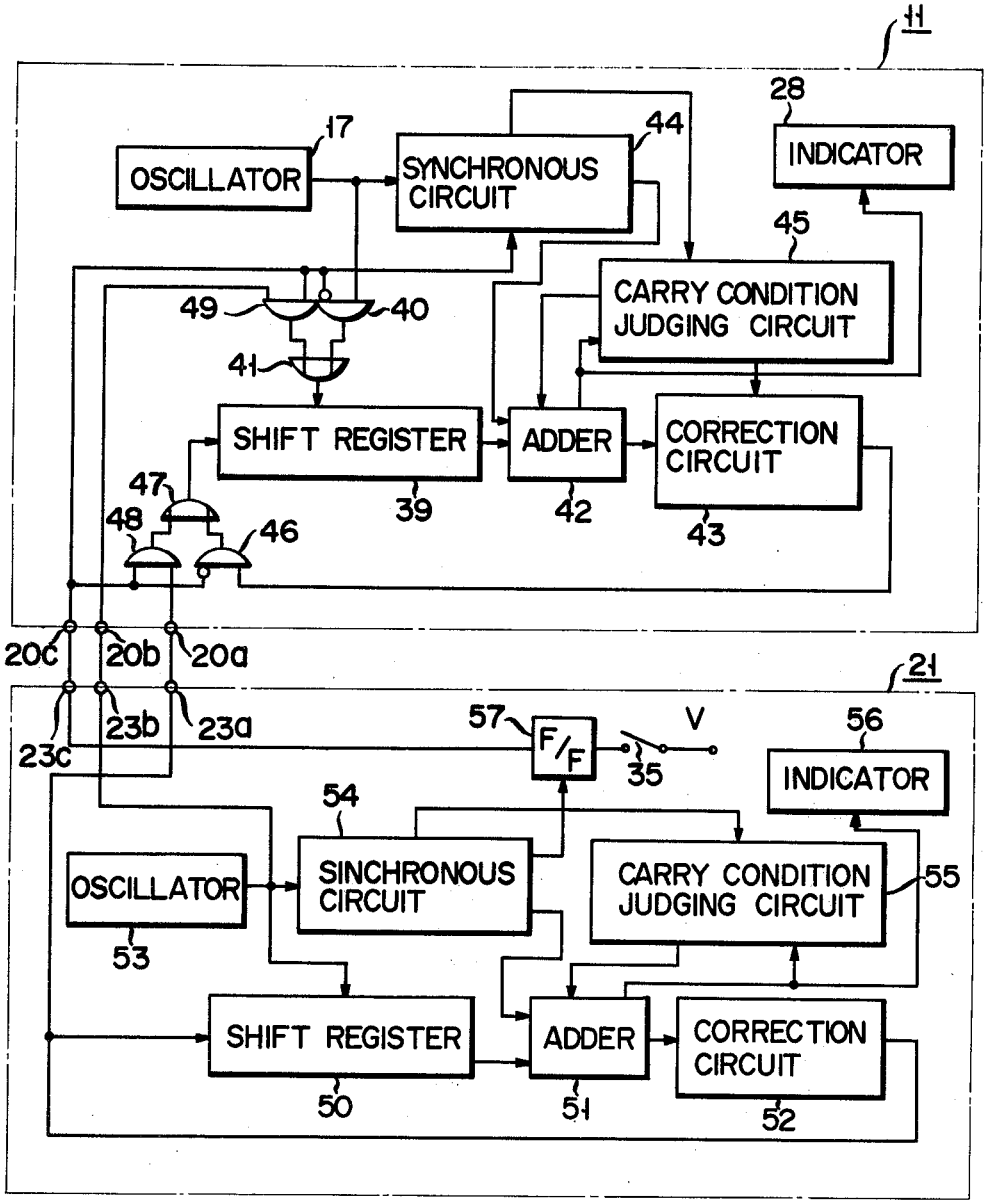
FIG. 6 is a block diagram showing a master device and an electronic timepiece according to another embodiment of this invention.

In the above-mentioned embodiment the time count circuit is comprised of the time counters corresponding to the respective time count units, but it may be comprised of a shift register as shown, for example, in FIG. 6.

In FIG. 6 the shift register 39 constitutes the time count circuit and the oscillation clock signals of the oscillator 17 is delivered as a shift drive signal to the shift register 39 through an AND circuit 40 and OR circuit 41. A circulating shift circuit is added to the shift register 39 through an adder 42 and correction circuit 43. A wristwatch having such a shift register is disclosed in U.S. Pat. No. 3,788,058. That is, the shift register 39 comprises 4-bit time count units such as a 1-second unit, 10-second unit, 1-hour unit, etc. A synchronizing circuit 44 is controlled by the oscillation signal of the oscillator 17 and, by a 1 P/S output signal of the synchronizing circuit 44, "1" is added at the adder 42 to a minimum unit digit position data (i.e. a 1-second digit position data) and when a count value in the 1-second digit position becomes "10", the 1-second digit position of the register 39 is cleared and "1" is added to a "10-second" digit position i.e. a unit digit position next higher in rank than the minimum unit digit position. Then, a "minute", a "hour" data, etc. are sequentially set to the corresponding unit digit positions of the shift register 39 with "1" being added to the corresponding unit digit position according to the corresponding carry requirement. In this way, a time counting operation is carried out.

Such a carry requirement is effected as follows. In synchronism with a time count data inputted from the "second" unit digit position of the register 39 to the adder 42 a 1 P/S signal is added from the synchronizing circuit 44 to the adder 42. The time count data inputted to the adder 42 is sequentially judged by the carry requirement judging circuit 45. When a predetermined carry requirement data for each time unit comes into the adder 42 and it is judged by the carry requirement judging circuit 45, an instruction for adding "1" to the corresponding higher order digit position is given to the adder 42. The time count data so shifted is circulated through the correction circuit 43 to the shift register 39 until the carry data is judged by the carry requirement judging circuit 45. When the carry data is judged by the carry requirement judging circuit 45 the time count data in the correction circuit 43 is cleared by an instruction signal from the carry requirement judging circuit 45. The time count data in the adder 42 is digitally displayed at the display device 28.

In the wristwatch 11 shown in FIG. 6 the shift circulating circuit of the shift register 39 includes a series circuit of an AND circuit 46 and OR circuit 47. The AND circuit 46 having one inverting input terminal, receives a signal from the contact terminal 20c through its inverting input terminal and has its gate normally opened. The signal from the contact terminal 20c is also supplied as a gate signal to the inverting input terminal of the AND circuit 40. The signal from the contact terminal 20c is supplied, together with a time count data from a contact terminal 20c, to an AND circuit 48 and the output of the AND circuit 48 is supplied through the OR circuit 47 to the input of the shift register 39. The control signal from the contact terminal 20c is supplied as a reset instruction to the synchronizing circuit 44 and it is also supplied, together with a clock signal from the contact terminal 20b, to an AND circuit 49. The output of the AND circuit 49 is supplied through the OR circuit 41 to the shift register 39 for shift drive.

A master device 21 is so constructed that it is basically operated in the same manner as the wristwatch 11. A shift register 50 and a shift circulating circuit including an adder 51 and correction circuit 52 are constructed in the same manner as in the wristwatch 11 in FIG. 6, and the shift register 50 is shift-driven upon receipt of clock signals from an oscillator 53. The clock signal of the oscillator 53 is also supplied to the projecting terminal 23b and to a synchronizing circuit 54 for drive control. The synchronizing circuit 54 corresponds to the frequency divider 13, shift pulse generator 14, bit pulse generator 15 and digit pulse generator 16 as shown, for example, in FIG. 1 of U.S. Pat. No. 3,788,058. An end pulse from the last digit position of the synchronous circuit 54 is supplied to the flip-flop circuit 57. The adder 51 and carry requirement judging circuit 55 are controlled by the synchronizing circuit 54. In this way, a time counting operation is effective and a time display is effected at a display device 56. When an instruction switch 35 is closed, a flip-flop circuit 57 is operated. The flip-flop circuit 57 is set and reset by an end pulse as obtained from the synchronizing circuit 54 for each shift circulation of the shift register 50. That is, the end pulse is generated at such a timing that after the end of a shifted data enters in the input end of the shift register 50 the head of the data is outputted. That is, the flip-flop circuit 57 is set during one cycle of the shift register 50. At the set time of the flip-flop circuit 57 a control signal appears at the projecting terminal 23c, causing the gate of the AND circuit 40 in the wristwatch 11 to be closed and the gate of the AND circuit 49 to be opened to permit the shift register 39 in the wristwatch 11 to be driven by the clock signals from the master device 21. Since at this time the AND circuit 48 is gated by the clock signal from the master device 21, the output data of the shift register 50 is supplied to the projecting terminal 23a and a setting time count data present in the shift register 50 in the master device 21 is shifted into the shift register 39 in the wristwatch 11. In this way, a setting time data is written in the wristwatch 11.

In the above-mentioned embodiment the master device 21 is provided separately from the wristwatch 11 and a time setting is effected by bringing the contact terminals of the wristwatch into engagement with the projecting contacts 23a, 23b and 23c of the master device. However, the wristwatch 11 and master device 21 can be embodied as one transmit/receive timepiece as shown in FIG. 7.

Figure 7:
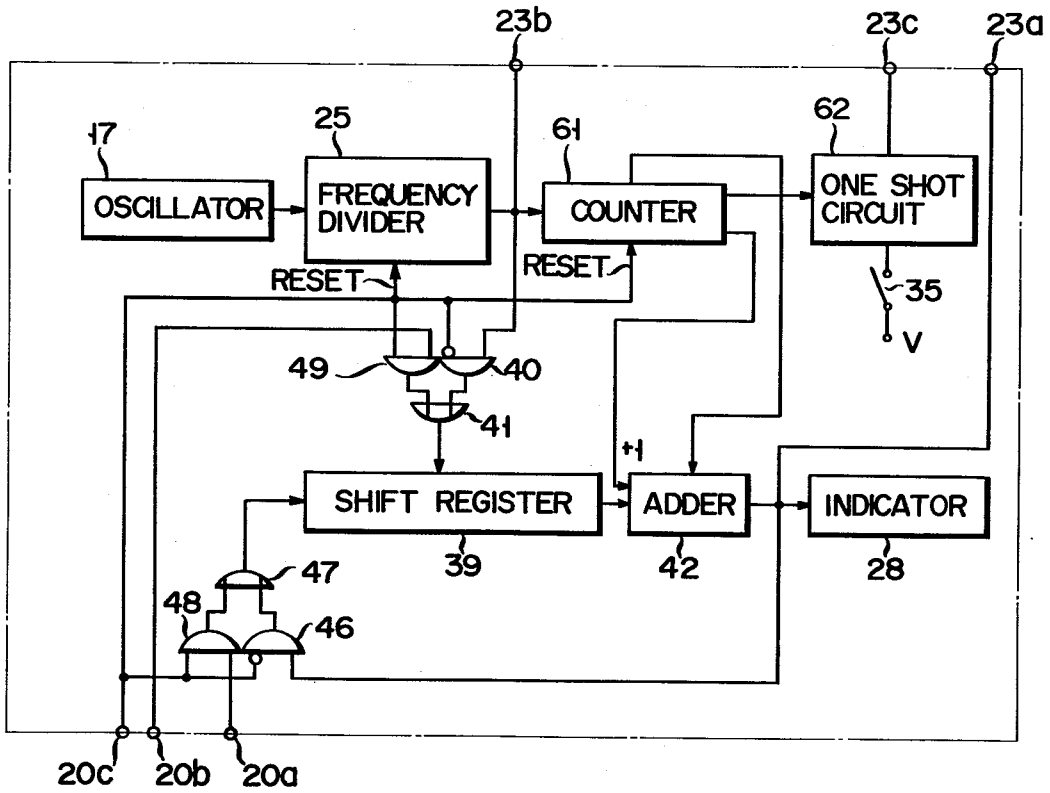
FIG. 7 is a block diagram showing an electronic timepiece according to a third embodiment of this invention which can act as an electronic timepiece and master device.

In FIG. 7, like reference numerals are employed to designate like parts or elements shown in FIGS. 5 and 6 and further explanation is therefore omitted. When a setting time is preset into a wristwatch a contact terminal 20a is used as a terminal into which a setting time data is inputted from an external device; a contact terminal 20b as a terminal to which is inputted a clock signal which permits a shift control of the shift register 39; and a contact terminal 20a as a terminal to which an instruction signal is inputted in setting the wristwatch right. The output of a frequency divider 25 is supplied as a shift instruction signal to the shift register 39 through an AND circuit 40 and OR circuit 41 and it is also supplied to a counter 61. The output of the counter 61 is applied as a +1 add instruction to an adder 42. The counter 61 is reset by a control signal which is inputted in setting the wristwatch correct and the AND circuit 40 is inhibited. On the other hand, a clock signal from a contact 20b is supplied as a shift signal to the shift register 39 through an AND circuit 49, permitting a setting time data from the contact terminal to be inputted through an AND circuit 48 and OR circult 47 to the shift register 39. The setting time data so inputted into the shift register 39 is displayed on a display device 28 through an adder 42.

When, on the other hand, the timepiece in FIG. 7 is used as a master device for another wristwatch, the output of the frequency divider 25 is supplied as a shift instruction to a time count circuit of the wristwatch through a projecting terminal 23b. When a time correction is effected, the output of the counter 61 is supplied, by the operation of a switch 35, as a control instruction signal to the wristwatch through a one-shot circuit 62 and contact terminal 23c. In this way, a correct time count data from the adder 24 is supplied from the projecting terminal 23c to the time count circuit in the wristwatch. As a result, the wristwatch is set correctly.

This invention can be changed in a variety of ways without departing from the spirit and scope of this invention.

What is claimed is:

1. An electronic timepiece comprising:

a reference oscillator means for generating reference clock signals;

count means for counting reference clock signals from said reference oscillator means to obtain a time count value;

an electroconductive terminal for data input which is to be connected directly to an external data supply device and into which a preset data which is involved during setting of the time is inputted; and a second electroconductive terminal to which is connected a control signal for writing the preset data from the external data supply device into said count means.

2. An electronic timepiece according to claim 1, comprising means for bringing said timepiece into a detachable, elastic direct engagement with said external data supply device.

3. An electronic timepiece according to claim 1, wherein said count means includes a shift register; and said timepiece further comprises a multi-input gating means for coupling the output of said reference oscillator means to said shift register, one input of said gating means being coupled to the output of said reference oscillator means and the output thereof being coupled to said count means; and wherein said data input terminal is coupled to another input of said gating means.

4. An electronic timepiece according to claim 1, further comprising removable cover means for selectively covering and providing access to said first and second electroconductive terminals.

5. An electronic timepiece according to claim 4, further comprising a battery for operating said electronic timepiece, said cover means further selectively covering and providing access to said battery.

6. An electronic timepiece apparatus comprising:

an external data supply device for supplying preset time data and a control signal;

an electronic timepiece including a reference oscillator means for generating reference clock signals, count means for counting reference clock signals from said reference oscillator means to obtain a time count value, display means coupled to said count means for displaying the time count value of said count means for time display, a first electroconductive terminal for data input which is to be connected directly to an external data supply device and into which a preset data involved during setting of the time is inputted, and a second electroconductive terminal to which is to be connected to receive a control signal for writing the preset data from said external data supply device into said count means;

said external data supply device including electroconductive output terminals directly connectable to said first and second electroconductive terminals of said electronic timepiece, and means for supplying the preset data and the input control signal to said electronic timepiece through said electroconductive output terminal.

7. An electronic timepiece apparatus according to claim 6, wherein said external data supply device comprises a master timepiece device.

8. An electronic timepiece apparatus according to claim 7, wherein said master timepiece of said external data supply device comprises an external time count circuit coupled to an external reference oscillator means, said time count circuits of said electronic timepiece and external data supply device both being driven by the same signal during setting of the time.

9. An electronic timepiece apparatus according to claim 6, comprising means for bringing said timepiece into a detachable, elastic direct engagement with said external data supply device.

10. An electronic timepiece apparatus according to claim 6, wherein said count means includes a shift register; and said electronic timepiece further comprises gating means for coupling the output of said reference oscillator means to said shift register, one input of said gating means being coupled to the output of said reference oscillator means and the output thereof being coupled to said count means; and wherein said first electroconductive terminal is coupled to another input of said gating means.

11. An electronic timepiece apparatus according to claim 6, wherein said electronic timepiece further comprises removable cover means for selectively covering and providing access to said first and second electroconductive terminals.

12. An electronic timepiece apparatus according to claim 11, wherein said electronic timepiece further comprises a battery for operating same, and said cover means further selectively covering and providing access to said battery.

13. An electronic timepiece comprising:

a reference oscillator means for generating reference clock signals;

count means for counting reference clock signals from said reference oscillator means;

display means coupled to said count means for displaying the time count value of said count means;

an electroconductive input terminal for connection directly to an external data supply device for receiving a preset initial value data which is inputted from the outside and for coupling said initial value data to said count means at a time setting time; and an electroconductive output terminal directly connectable to another external electronic timepiece for supplying the time count value of said count means to said another external electronic timepiece.

14. An electronic timepiece according to claim 13, in which said output terminal is connected directly and elastically to said another external timepiece in a detachable fashion.

15. An electronic timepiece according to claim 13, further comprising removable cover means for selectively covering and providing access to said electroconductive terminals.

16. An electronic timepiece according to claim 15, further comprising a battery for operating said electronic timepiece, said cover means further selectively covering and providing access to said battery.

* * * * *